United States Patent [19]

Willers et al.

[11] 4,319,699

[45] Mar. 16, 1982

[54] PORTABLE SPRAYER ACTUATED BY USER'S BODY MOVEMENT

[75] Inventors: Albertus V. Z. Willers, Pretoria; Willem J. Neser, Kempton Park, both of South Africa

[73] Assignee: D.A.S. Pumps (Proprietary) Limited, Sandton, South Africa

[21] Appl. No.: 162,922

[22] Filed: Jun. 25, 1980

[30] Foreign Application Priority Data

Jun. 25, 1979 [ZA] South Africa ..... 79/3160

[51] Int. Cl.[3] ..... B67D 5/64; B67D 5/42

[52] U.S. Cl. ..... 222/175; 222/309; 222/383; 417/234

[58] Field of Search ..... 222/1, 175, 179, 309, 222/383; 239/152, 153, 154; 417/118, 229, 234, 903

[56] References Cited

U.S. PATENT DOCUMENTS

| | | | |
|---|---|---|---|
| 218,789 | 8/1879 | Spalding | 239/154 X |
| 496,141 | 4/1893 | Simms | 222/309 X |
| 536,909 | 4/1895 | Banks | 222/175 X |
| 626,469 | 6/1899 | Taylor | 239/152 X |
| 632,418 | 9/1899 | Landis | 417/234 X |
| 1,071,876 | 9/1913 | Campau | 239/152 X |
| 1,676,424 | 7/1928 | Carr | 222/175 |
| 1,998,734 | 4/1935 | Parker | 239/152 |
| 3,097,763 | 7/1963 | Alvotto | 222/309 X |
| 3,926,345 | 12/1975 | Pulk et al. | 222/309 X |

FOREIGN PATENT DOCUMENTS

| | | | |
|---|---|---|---|
| 46969 | 2/1933 | Denmark | 239/154 |

*Primary Examiner*—Gil Weidenfeld
*Assistant Examiner*—Fred A. Silverberg
*Attorney, Agent, or Firm*—Stevens, Davis, Miller & Mosher

[57] ABSTRACT

A portable spraying device having a pressurizable container and a reciprocating piston pump for pressurizing the container. The pump is attachable between the back and thigh of the user so that relative movement between these body parts during walking is operative to drive the pump so as to pressurize the container.

3 Claims, 1 Drawing Figure

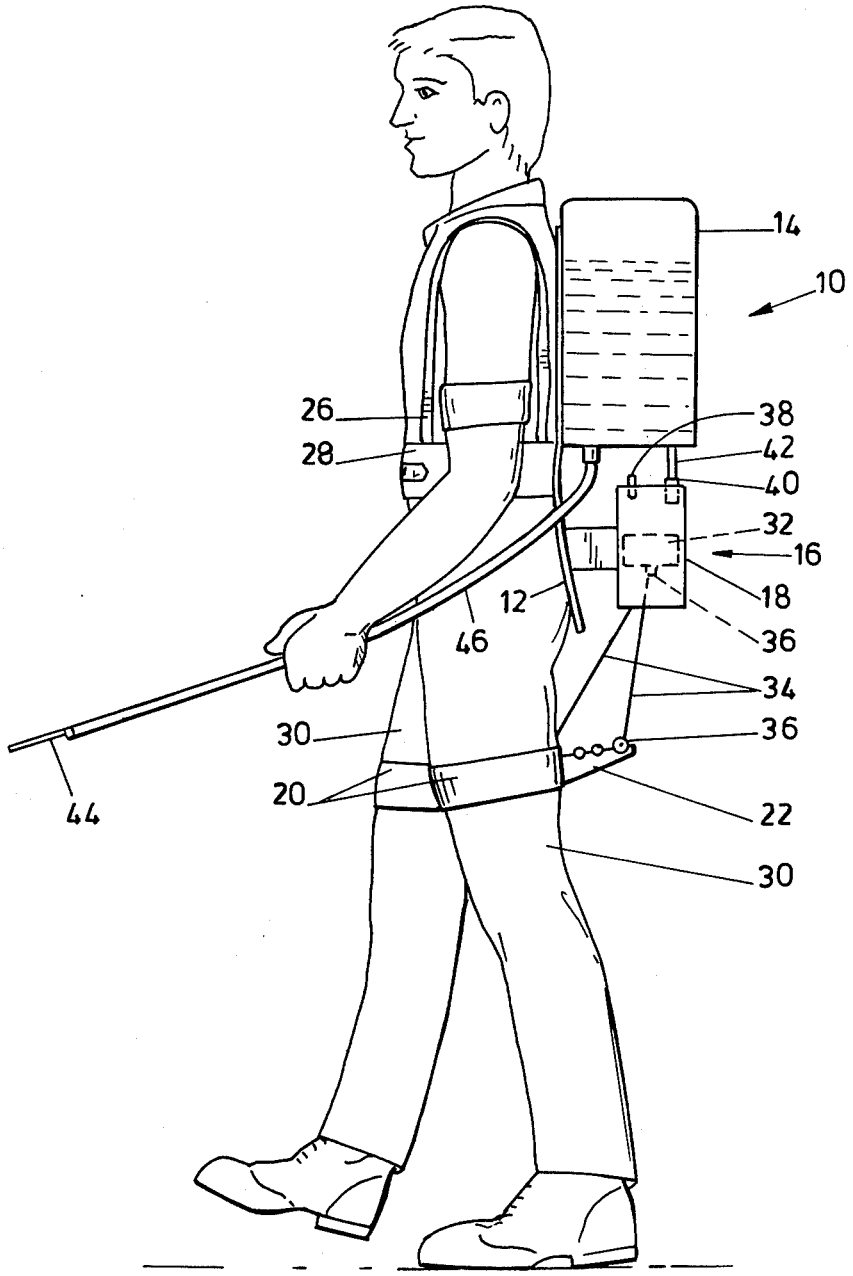
14
10
26
28
38
42
40
32
16
18
12
46
36
34
30
36
20
22
44
30

PORTABLE SPRAYER ACTUATED BY USER'S BODY MOVEMENT

This invention relates to a portable spraying device for spraying a liquid, of the kind comprising a pressurizable container for containing the liquid to be sprayed and/or compressed air for use in propelling the liquid. It also relates to a method of pressurizing or maintaining the pressure in the container of such a device.

According to the invention there is provided a portable spraying device for spraying a liquid, which comprises a pressurizable container for containing the liquid to be sprayed and/or compressed air for use in propelling the liquid, and pressurizing means for pressurizing or maintaining the pressure in the container, the pressurizing means being adapted to be attached to two body parts of a user, the one body part being a thigh and the other body part being the back of the user, in such a manner that, during walking, relative movement between these body parts is operative to drive the pressurizing means so as to pressurize or maintain the pressure in the container.

The pressurizing means may include a reciprocating piston pump of which the piston is adapted to be connected to one of the body parts and the cylinder is adapted to be connected to the other body part.

Thus, the pressurizing means may further include a thigh band which can be strapped around the thigh of a user, and a carrier frame which can be strapped to the back of the user, the cylinder being connected to the carrier frame and the piston being connected to the thigh band, or vice versa.

The piston may be connected to the thigh band via a lever arm which is attached to the thigh band in such a manner as, in use, to extend away from the leg in the plane of movement of the leg during walking, the piston being connected to the lever arm at a point spaced from the point of attachment of the lever arm to the thigh band. The spacing between the point of connection of the piston to the lever arm and the point of attachment of the lever arm to the thing band may be variable.

The piston may be connected to the lever arm by means of a piston rod which has a variable length.

The container may be secured to the carrier frame.

Further according to the invention there is provided, in spraying a liquid by means of a portable spraying device having a pressurizing container containing the liquid to be sprayed and/or compressed air for propelling the liquid, the method of pressurizing or maintaining the pressure in the container which comprises utilizing relative movement between a thigh and the torso or back of the user during walking, to pressurize or maintain the pressure in the container.

Preferably, the relative motion between both thighs respectively of the user and the torso or back of the user may be utilized.

BRIEF DESCRIPTION OF THE DRAWING

The invention will now be described in more detail, by way of example, with reference to the accompanying diagrammatic drawing which shows a side view of a spraying device in accordance with the invention, strapped to the back of a user.

In the drawing, reference numeral 10 generally indicates a spraying device comprising a carrier frame 12, a pressurizable container 14 secured to the frame 12, a pair of reciprocating piston pumps 16 (only one of which is shown) secured by their cylinders 18 to the frame 12, and a pair of thigh bands 20 each having attached thereto a lever arm 22 (only one of which is shown).

The carrier frame 12 is strapped to the back of a user by means of a pair of shoulder straps 26 (only one of which is shown) and a waist band 28.

The thigh bands 20 are strapped to the user's thighs 30 in such a manner that the lever arms 22 extend rearwardly.

The piston 32 of the pump 16 shown is attached to the lever arm 22 by means of a piston rod 34 via swivel joints 36 at opposite ends of the piston rod. The piston rod 34 has a variable length such as by being telescopically extendible and being lockable in any one of a number of conditions of length.

The piston rod 34 is connectable to the lever arm 22 in any one of a number of different positions so that the spacing between the point of connection between the rod and the lever arm, and the point of connection between the lever arm and the thigh band 20 may be varied.

The piston 32 of the other pump 16 (not shown) is likewise connected to the other thigh of the user.

The pumps 16 each have a non-return inlwet valve 38 leading from atmosphere into the cylinder 18 and a nonreturn valve 40 leading via a pipe 42 into the container 14.

A spray nozzle 44 is connected to the container 14 via a flexible pipe 46.

The operation of the device is as follows. During walking, the user's thighs 30 execute a reciprocating arcuate movement relative to the user's back. Thus, the lever amrs 22 will also execute a reciprocating arcuate movement. The vertical component of such arcuate movement of the lever arms 22 will be transmitted to the pistons 32 via the piston rods 34, causing the pistons 32 to reciprocate vertically in the cylinders 18. This causes air to be drawn into the cylinders 18 via the non-return valves 38 and to be pumped from the cylinders into the container 14 via the non-return valves 40 and the pipes 42.

The length of the piston rods 34 may be varied to accommodate persons of different length. The volume of air pumped into the container 14 or the pressure thereof when it is pumped into the container 14 may be adjusted by connecting the piston rod 34 in different positions to the lever arms 22. For example, when the piston rods 34 are connected to the lever arms 22 in positions near the free ends of the arms, then the stroke of the pumps 16 will be relatively long, providing a relatively large flow rate of air at a relatively low pressure. If, on the other hand, the piston rods 34 are connected to the lever arms 22 in positions near the points of connection of the lever arms to the thigh bands 20, then the stroke of the pumps 16 will, for the same degree of movement of the thighs 30, be relatively short, providing, for the same effort, a relatively small flow rate of air at a relatively high pressure.

It is an advantage of the device described above that the arms and hands of the user are not required to pressurise or maintain the pressure in the container 14. Both the user's arms and hands are therefore free to manipulate the spray nozzle 44 and perform other operations.

The pumps 16 shown in the drawing are single acting pumps. They may of course also be double acting pumps. The pumps 16 may be replaceable so that different pumps providing different flow rates or pressures may be mounted on the carrier frame 12 as desired.

Although reference is herein made to a "user", and the "user" is in the illustrated example indicated as a human being, it is to be understood that the spraying device may also be adapted for use on an animal. The term "user" should therefore be interpreted broadly as also including an animal.

We claim:

1. A portable spraying device for spraying a liquid, which comprises a pressurizable container for containing the liquid to be sprayed, attachment means for locating the container on the back of the user, a pump connected to the container and having a cylinder and a piston disposed in the cylinder for pressurizing the container, means to move the piston within the cylinder comprising a thigh band for securing to a thigh of the user and a lever arm attached to the thigh band so as, in use, to extend rearwardly and away from a user's leg in the generally vertical plane of movement of the leg during walking, means connecting the lever arm to one of the piston and the cylinder at a point spaced from the point of attachment of the lever arm to the thigh band so as to effect relative movement between the piston and the cylinder during walking.

2. A portable spraying device according to claim 1, including means to vary the spacing between the point of attachment of the lever arm to the thigh band and the connection to one of the piston and the cylinder.

3. A portable spraying device according to claim 2, wherein the lever arm is connected to the piston.

* * * * *